US006352819B1

(12) United States Patent
Kenney et al.

(10) Patent No.: US 6,352,819 B1
(45) Date of Patent: Mar. 5, 2002

(54) HIGH CONTRAST THERMALLY-DEVELOPABLE IMAGING MATERIALS CONTAINING BARRIER LAYER

(75) Inventors: Raymond J. Kenney, Woodbury; Paul G. Skoug, Stillwater; Takuzo Ishida, Woodbury; Lawrence B. Wallace, Newport, all of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/728,416

(22) Filed: Dec. 1, 2000

(51) Int. Cl.[7] ..... G03C 1/498; G03C 1/76; G03C 1/825

(52) U.S. Cl. ..... 430/353; 430/510; 430/517; 430/523; 430/536; 430/619; 430/264; 430/961; 430/964

(58) Field of Search ..... 430/353, 264, 430/510, 517, 523, 536, 619, 961, 964

(56) References Cited

U.S. PATENT DOCUMENTS

| | | | | |
|---|---|---|---|---|
| 4,741,992 | A | 5/1988 | Przezdziecki | 430/961 |
| 4,942,115 | A | 7/1990 | Przezdziecki | 430/961 |
| 5,422,234 | A | 6/1995 | Bauer et al. | 430/961 |
| 5,464,738 | A | 11/1995 | Lynch et al. | 430/619 |
| 5,468,603 | A | 11/1995 | Kub | 430/619 |
| 5,496,695 | A | 3/1996 | Simpson et al. | 430/619 |
| 5,545,507 | A | 8/1996 | Simpson et al. | 430/619 |
| 5,635,339 | A | 6/1997 | Murray | 430/619 |

FOREIGN PATENT DOCUMENTS

| | | |
|---|---|---|
| EP | 0 869 391 A1 | 10/1998 |
| EP | 0 897 130 A1 | 2/1999 |
| EP | 0 921 433 A1 | 6/1999 |
| EP | 0 959 383 A1 | 11/1999 |
| WO | WO 97/11409 | 3/1997 |

OTHER PUBLICATIONS

Co–pending U.S. Application, titled *Thermally–Developable Imaging Materials Containing Surface Barrier Layer*, A.M. Miller et al (D–81465) filed on even date herewith, Dec. 1, 2000.

*Primary Examiner*—Richard L. Schilling
(74) *Attorney, Agent, or Firm*—J. Lanny Tucker

(57) ABSTRACT

High contrast thermographic and photothermographic materials comprise a barrier layer to prevent migration of diffusible by-products resulting from high temperature development. The barrier layer comprises a film-forming polymer (s) that reacts with or acts as a physical barrier to diffusible by-products resulting from development including formic acid, hydrazo compounds, azo compounds, diimide compounds, hydrazine, and water.

26 Claims, No Drawings

HIGH CONTRAST THERMALLY-DEVELOPABLE IMAGING MATERIALS CONTAINING BARRIER LAYER

FIELD OF THE INVENTION

This invention relates to thermally-developable imaging materials such as thermographic and photothermographic materials. More particularly, it relates to high contrast thermographic and photothermographic imaging materials that provide greater protection against unwanted development in non-imaged areas. The invention also relates to methods of imaging using these materials. This invention is directed to the photothermographic and thermographic imaging industries.

BACKGROUND OF THE INVENTION

Silver-containing thermographic and photothermographic imaging materials that are developed with heat and without liquid development have been known in the art for many years.

Thermography or thermal imaging is a recording process wherein images are generated by the use of thermal energy. In direct thermography, a visible image is formed by imagewise heating a recording material containing matter than changes color or optical density upon heating. Thermographic materials generally comprise a support having coated thereon: (a) a relatively or completely non-photosensitive source of reducible silver ions, (b) a reducing composition (usually including a developer) for the reducible silver ions, and (c) a hydrophilic or hydrophobic binder.

Thermal recording materials become photothermographic upon incorporating a photosensitive catalyst such as silver halide. Upon imagewise exposure to irradiation energy (ultraviolet, visible or IR radiation) the exposed silver halide grains form a latent image. Application of thermal energy causes the latent image of exposed silver halide grains to act as a catalyst for the development of the non-photosensitive source of reducible silver to form a visible image. These photothermographic materials are also known as "dry silver" materials.

In such materials, the photosensitive catalyst is generally a photographic type photosensitive silver halide that is considered to be in catalytic proximity to the non-photosensitive source of reducible silver ions. Catalytic proximity requires an intimate physical association of these two components either prior to or during the thermal image development process so that when silver atoms [Ag(0)], also known as silver specks, clusters or nuclei) are generated by irradiation or light exposure of the photosensitive silver halide, those silver atoms are able to catalyze the reduction of the reducible silver ions within a catalytic sphere of influence around the silver atoms [Klosterboer, Neblette's Eighth Edition: *Imaging Processes and Materials*, Sturge, Walworth & Shepp (Eds.), Van Nostrand-Reinhold, New York, Chapter 9, pages 279–291, 1989]. It has long been understood that silver atoms act as a catalyst for the reduction of silver ions, and that the photosensitive silver halide can be placed into catalytic proximity with the non-photosensitive source of reducible silver ions in a number of different ways (see, for example, *Research Disclosure*, June 1978, Item No. 17029). Other photosensitive materials, such as titanium dioxide, cadmium sulfide, and zinc oxide have been reported to be useful in place of silver halide as the photocatalyst in photothermographic materials [see for example J. W. Shepard, *J. Appl. Photog. Eng.* 1982, 8(5), 210–212, S. Shigeo, et al., *Nippon Kagaku Kaishi*, 1994, 11, 992–997, and FR 2 254 047 (Robillard)].

The photosensitive silver halide may be made "in situ," for example by mixing an organic or inorganic halide-containing source with a source of reducible silver ions to achieve partial metathesis and thus causing the in-situ formation of silver halide (AgX) grains on the surface of the silver source [see, for example, U.S. Pat. No. 3,457,075 (Morgan et al.)].

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and photothermographic material. The preformed silver halide grains may be introduced prior to and be present during the formation of the silver soap. Co-precipitation of the silver halide and source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids". Salts of other organic acids or other organic compounds, such as silver imidazolates, silver benzotriazoles, silver tetrazoles, silver benzotetrazoles, silver benzothiazoles and silver acetylides have been proposed. U.S. Pat. No. 4,260,677 (Winslow et al.) discloses the use of complexes of various non-photosensitive inorganic or organic silver salts.

In photothermographic emulsions, exposure of the photosensitive silver halide to light produces small clusters of silver atoms $[Ag(0)]_n$. The imagewise distribution of these clusters, known in the art as a latent image, is generally not visible by ordinary means. Thus, the photosensitive emulsion must be further developed to produce a visible image. This is accomplished by the reduction of silver ions that are in catalytic proximity to silver halide grains bearing the clusters of silver atoms (that is, the latent image). This produces a black-and-white image. The non-photosensitive silver source is reduced to form the visible black-and-white negative image while much of the silver halide, generally, remains as silver halide and is not reduced.

In photothermographic materials, the reducing agent for the non-photosensitive reducible silver ions, often referred to as a "developer," may be any compound that in the presence of the latent image, can reduce silver ions to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reduction occurs preferentially in the regions surrounding the latent image. In photothermographic materials, this reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing using aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the photosensitive silver halide serves as a catalyst for the physical development of the non-photosensitive source of reducible silver ions. In contrast, conventional wet-processed, black-and-white photographic materials use only one form of silver that, upon chemical development, is itself converted into the silver image, or that upon physical development requires addition of an external silver source. Thus, photothermographic materials require an amount of silver halide per unit area that is only a fraction of that used in conventional wet-processed photographic materials.

In photothermographic materials, all of the "chemistry" for imaging is incorporated within the material itself. For example, they include a developer (that is, a reducing agent for the reducible silver ions) while conventional photographic materials usually do not. Even in so-called instant photography, the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they pose different considerations and present distinctly different problems in manufacture and use, compared to conventional, wet-processed silver halide materials. In addition, the effects of additives (for example, stabilizers, antifoggants, speed enhancers, chemical and spectral sensitizers and super-sensitizers) that are intended to have a direct effect upon the imaging process, can vary depending upon whether they have been incorporated in a photothermographic material or a photographic material. For example, it is not uncommon for a photographic antifoggant useful in conventional photographic materials to cause various types of for when incorporated into photothermographic materials or for a supersenstizer that is effective in a photographic material to be ineffective in a photothermographic material.

The benefits of using such additives in one type of material (for example photographic materials) are not predictive of whether such additives will provide the same or some other desired benefit in photothermographic materials. Additives that have one effect in conventional silver halide photography may behave quite differently in photothermographic materials where the underlying chemistry is so much more complex. For example, it is not uncommon for a photographic antifoggant useful in conventional photographic materials to cause various types of fog when incorporated into photothermographic materials. Furthermore, some supersensitizers that are effective in photographic materials are inactive in photothermographic materials.

These and other distinctions between photothermographic and photographic materials are described in *Imaging Processes and Materials* (Neblette's Eighth Edition), noted above, *Unconventional Imaging Processes*, E. Brinckman et al (Eds.), The Focal Press, London and New York, 1978, pages 74–75, and in Zou, Sahyun, Levy and Serpone, *J. Imaging Sci. Technol.* 1996,40, pages 94–103.

Problem to be Solved

High contrast photothermographic materials offer many advantages over conventional high contrast films that are processed with wet developing and fixing solutions. They provide the desired images quickly without the need for the processing chemicals and the multi-step processing wet methods. High contrast in such materials is generally achieved by the presence of various high contrast agents such as certain hydrazides, acrylonitrile and other compounds known in the art for this purpose.

However, we have found that when such high contrast agents are used in photothermographic imaging materials, low molecular weight by-products such as fogging agents may be released from the high contrast agents during development with heat. These by-products may migrate from the imaged areas and cause development in non-imaged areas. There is a need to prevent migration of these by-products in order to improve image quality and to increase the activity of the imaging components within photothermographic materials.

SUMMARY OF THE INVENTION

The problems noted above are solved with a high contrast black-and-white photothermographic material comprising a support having thereon:

a) a thermally-developable, high contrast imaging layer(s) comprising a binder and in reactive association, a photosensitive silver halide, a non-photosensitive source of reducible silver ions, a reducing composition for the non-photosensitive source of reducible silver ions, and a high contrast agent, and b) a barrier layer that is on the same side but farther from the support than the high contrast imaging layer(s), the barrier layer comprising a film-forming polymer and being impermeable to or reactive with any components that are diffusible from the image-forming layer(s) at a temperature greater than 80° C.

One particularly useful embodiment of the present invention is a high contrast black-and-white photothermographic material comprising a support having on one side thereof:

a) a thermally-developable, high contrast imaging layer(s) comprising a binder and in reactive association, a photosensitive silver halide, one or more non-photosensitive silver carboxylates, a hindered phenol reducing agent, an alkyl(hydroxy-methylene) cyanoacetate high contrast agent, and a polyhalo antifoggant, b) a barrier layer that is farther from the support than the high contrast imaging layer(s), the barrier layer comprising a film-forming polymer that is selected from the group consisting of polyvinyl alcohol (with or without silica), a styrene polymer, a vinyl halide polymer, a vinyl acetate polymer, a polyvinyl pyrrolidone, a water-soluble or water-dispersible polyester, or gelatin or a gelatin derivative, the barrier layer being impermeable to or reactive with formic acid, hydrazo compounds, azo compounds, diimide compounds, hydrazine, or water, and optionally c) a protective layer that can be a topcoat over the barrier layer, or a layer disposed between the barrier layer and the imaging layer(s)

the photothennographic material also comprising an antihalation layer on said support, the antihalation layer comprising a binder and an antihalation dye.

This invention also provides a high contrast black-and-white thermographic material comprising a support having thereon:

a) a thermally-developable and non-photosensitive, high contrast imaging layer(s) comprising a binder and in reactive association, a non-photosensitive source of reducible silver ions, a reducing composition for the non-photosensitive source of reducible silver ions, and a high contrast agent, and b) a barrier layer that is farther from the support than the high contrast imaging layer(s), the barrier layer comprising a film-forming polymer and being impermeable to or reactive with any components that are diffusible from the image-forming layer(s) at a temperature greater than 80° C.

This thermographic material can be used to provide an image by applying thermal energy to it in an imagewise fashion.

Further, a method of this invention for forming a visible image comprises:

A) imagewise exposing the high contrast black-and-white photothermographic material described above to electromagnetic radiation to form a latent image, and B) simultaneously or sequentially, heating the exposed photothermographic material to develop the latent image into a visible image.

The method of this invention can also include the additional steps of:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

It has been found that improved image quality and robustness can be achieved by placing a barrier layer between the high contrast imaging layer(s) of the materials and the outer surface. In some embodiments, the barrier layer serves as the surface layer, but in other embodiments, the barrier layer can be disposed between the high contrast imaging layer(s) and a surface protective layer or topcoat. In another embodiment, the protective layer is disposed between the barrier layer and the high contrast imaging layer(s). In each embodiment, the barrier layer prevents or reduces migration of low molecular weight, diffusible chemicals such as fogging agents (for example, formic acid) that may be released from the high contrast agents during exposure to thermal energy at 80° C. or more from leaving the imaging layer(s). By preventing these chemicals from migrating out of the imaged material, development in non-image areas is reduced. Migration of the chemicals is reduced by the nature of the materials used in the barrier layer and/or its low permeability.

The barrier layer may also provide other advantages such as improved shelf stability for the materials before use and improved adhesion to underlying layers.

DETAILED DESCRIPTION OF THE INVENTION

The thermographic and photothermographic materials of this invention can be used, for example, in conventional black-and-white photothermography, in electronically generated black-and-white hardcopy recording, in the graphic arts area (for example imagesetting, and phototypesetting), in the manufacture of printing plates, in proofing, in microfilm applications and in radiographic imaging. Furthermore, the absorbance of these materials between 350 and 450 nm is sufficiently low to permit their use in graphic arts applications such as contact printing, proofing, and duplicating.

The remaining disclosure will be directed to the preferred photothermographic materials, but it would be readily apparent that such materials can be readily modified to act as thermographic materials and used under thermographic imaging conditions known in the art.

In the photothermographic materials of this invention, the components needed for imaging can be in one or more layers. The layer(s) that contain the photosensitive photocatalyst (such as photosensitive silver halide), non-photosensitive source of reducible silver ions, or both, are referred to herein as photothennographic emulsion layer(s) or as imaging layers. The photocatalyst and the non-photosensitive source of reducible silver ions are in catalytic proximity (or reactive association) and preferably are in the same layer.

Various layers are usually disposed on the "backside" (non-emulsion side) of the materials, including antihalation layer(s), protective layers, transport enabling layers, primer or subbing layers, conducting layers, and antistatic layers.

Various layers are also usually disposed on the "frontside" or emulsion side of the support including protective topcoat layers, primer layers, interlayers, opacifying layers, antistatic layers, acutance layers, conductive layers, subbing or primer layers, auxiliary layers and others readily apparent to one skilled in the art, as well as the barrier layer described herein.

The present invention also provides a process for the formation of a visible image (usually a black-and-white image) by first exposing to suitable electromagnetic radiation and thereafter heating the inventive photothermographic material. Thus, in one embodiment, the present invention provides a process comprising:

A) imagewise exposing the photothermographic material of this invention to electromagnetic radiation to which the photocatalyst (for example photosensitive silver halide) of the material is sensitive, to generate a latent image, and B) simultaneously or sequentially, heating the exposed material to develop the latent image into a visible image.

This visible image can also be used as a mask for exposure of other photosensitive imageable materials, such as graphic arts films, proofing films, printing plates and circuit board films, that are sensitive to suitable imaging radiation (for example UV radiation). This is done by imaging an imageable material (such as a photopolymer, a diazo material, a photoresist, or a photosensitive printing plate through the exposed and heat-developed photothermographic material of this invention using steps C) and D) noted above.

When the photothermographic materials used in this invention are heat developed as described below in a substantially water-free condition after, or simultaneously with, imagewise exposure, a silver image (preferably black-and-white silver image) is obtained. The photothermographic material may be exposed in step A with ultraviolet, visible, infrared, or laser radiation such as from an infrared laser, a laser diode, an infrared laser diode, a light emitting screen, a CRT tube, a light emitting diode, or any other radiation source readily apparent to one skilled in the art.

Definitions

As used herein:

In the descriptions of the photothermographic materials of the present invention, "a" or "an" component refers to "at least one" of that component. For example, the chemical materials (including polymers) described herein for the barrier layer can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, page 374.

"Photothermographic material(s)" means a construction comprising at least one photothermographic emulsion layer or a "two trip" photothermographic set of layers (the "two-trip "coating where the silver halide and the source of reducible silver ions are in one layer and the other essential components or desirable additives are distributed as desired in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer," or "photothermographic emulsion layer" means a layer of a photothermographic material that contains the photosensitive silver halide and/or non-photosensitive source of reducible silver ions. These layers are usually on what is known as the "frontside" of the support.

"Ultraviolet region of the spectrum" means that region of the spectrum less than or equal to 410 nm, preferably from about 100 nm to about 410 nm although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 750 nm. Preferably the red region of the spectrum is from about 620 nm to about 700 nm.

"Infrared region of the spectrum" refers to that region of the spectrum of from about 750 nm to about 1400 nm.

"Non-photosensitive" means not intentionally light sensitive.

"Transparent" means capable of transmitting visible light or imaging radiation without appreciable scattering or absorption.

As is well understood in this area, substitution is not only tolerated, but is often advisable and substitution is anticipated on the compounds used in the present invention.

For the compounds disclosed herein, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where there is a benzene ring structure shown substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, and octadecyl, but also alkyl chains bearing substituents known in the art, such as hydroxyl, alkoxy, thioalkyl, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of various types of silver halides can also be used in any suitable proportion. Silver bromide and silver bromoiodide are more preferred, the latter silver halide including up to 10 mol % silver iodide.

The shape of the photosensitive silver halide grains used in the present invention is in no way limited. The silver halide grains may have any crystalline habit including, but not limited to, cubic, octahedral, tetrahedral, orthorhombic, tabular, laminar, twinned, and platelet morphologies. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell-type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.). Iridium and/or copper doped core-shell and non-core-shell grains are described in U.S. Pat. No. 5,434,043 (Zou et al.), U.S. Pat. No. 5,939,249 (Zou), and EP-0 627 660B 1 (Shor et al.), all incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ prepared silver halide. In this process, the source of reducible silver ions, such as a long chain fatty acid silver carboxylate (commonly referred to as silver "soap") is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed emulsions" or "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized, such lower limit, for example being about 0.01 or 0.005 $\mu$m.

The average size of the photosensitive doped silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in The Theory of the Photographic Process, C. E. Kenneth Mees and T. H. James, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)].

It is also effective to use an in situ process in which a halide-containing compound is added to an organic silver salt to partially convert the silver of the organic silver salt to silver halide. The halide-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, Item No. 17029, U.S. Pat. No. 3,700,458 (Lindholm) and U.S. Pat. No. 4,076,539 (Ikenoue et al.), and JP Applications 13224/74, 42529/76 and 17216/75. *Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y 10011).

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

The silver halide used in the present invention may be employed without modification. However, it is preferably chemically and/or spectrally sensitized in a manner similar to that used to sensitize conventional wet-processed silver halide photographic materials or state-of-the-art heat-developable photothermographic materials.

For example, the photothermographic material may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in James, *The Theory of the Photographic Process*, Fourth Edition, Chapter 5, pages 149 to 169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh) and U.S. Pat. No. 3,297,446 (Dunn). One preferred method of chemical sensitization is by oxidative decomposition of a spectral sensitizing dye in the presence of a photothermographic emulsion, as described in U.S. Pat. No. 5,891,615 (Winslow et al.) incorporated herein by reference.

Another useful class of chemical sensitizers are tetrasubstituted thioureas as described in copending and commonly assigned U.S. Ser. No. 09/667,748 (filed Sep. 21, 2000 by Lynch, Simpson, Shor, Willett, and Zou). These compounds are thioureas in which the nitrogen atoms directed attached to the one or more sulfur atoms are fully substituted with monovalent or divalent groups.

The addition of sensitizing dyes to the photosensitive silver halides provides high sensitivity to ultraviolet, visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.) and U.S. Pat. No. 5,314,795 (Helland et al.) are effective in the practice of the invention.

An appropriate amount of sensitizing dye added is generally about $10^{-10}$ to 1 mole, and preferably, about $10^{-6}$ to $10^{-1}$ moles per mole of silver halide.

To enhance the speed and sensitivity of the photothermographic materials, it is often desirable to use one or more supersensitizers that increase the sensitivity to light. For example, preferred infrared supersensitizers are described in U.S. Pat. No. 5,922,529 (Tsuzuki et al.) and in EP-A-0 559 228 (Philip Jr. et al.) and include heteroaromatic mercapto compounds or heteroaromatic disulfide compounds of the formulae: Ar—S—M and Ar—S—S—Ar, wherein M represents a hydrogen atom or an alkali metal atom. Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. However, compounds having other heteroaromatic rings are envisioned to be suitable supersensitizers.

The heteroaromatic ring may also carry substituents. Examples of preferred substituents are halogens (such as bromine and chlorine), hydroxy, amino, carboxy, alkyl groups (for example of 1 or more carbon atoms and preferably 1 to 4 carbon atoms) and alkoxy groups (for example of 1 or more carbon atoms and preferably of 1 to 4 carbon atoms).

Mercapto supersensitizers are most preferred. Examples of preferred supersensitizers are 2-mercaptobenzimidazole, 2-mercapto-5-methylbenzimidazole, 2-mercaptobenzothiazole, 2-mercaptobenzoxazole, and mixtures thereof.

If used, a supersensitizer is generally present in an emulsion layer in an amount of at least about 0.0001 mole per mole of silver in the emulsion layer. More preferably, a supersensitizer is present within a range of about 0.0001 mole to about 1.0 mole, and most preferably, about 0.005 mole to about 0.2 mole, per mole of silver halide.

Non-Photosensitive Source of Reducible Silver Ions

The non-photosensitive source of reducible silver ions used in photothermographic materials of this invention can be any material that contains reducible silver ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain fatty carboxylic acids are preferred. The chains typically contain 10 to 30, and preferably 15 to 28, carbon atoms. Suitable organic silver salts include silver salts of organic compounds having a carboxylic acid group. Examples thereof include silver salts of aliphatic carboxylic acids and silver salts of an aromatic carboxylic acids. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof, hydrocarbon chains having ether or thioether linkages, or sterically hindered substitution in the α-(on a hydrocarbon group) or ortho-(on an aromatic group) position. Preferred examples of the silver salts of aromatic carboxylic acid and other carboxylic acid group-containing compounds include, but are not limited to, silver benzoate, a silver-substituted benzoate, such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-O 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-l-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678].

Furthermore, a silver salt of a compound containing an imino group can be used. Preferred examples of these compounds include but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described for example in U.S. Pat. No. 4,761,361 (Ozaki et al.) and U.S. Pat. No. 4,775,613 (Hirai et al.).

It may also be convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing about 22% silver, can be used. For opaque photothermographic materials, different amounts can be used. The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

The photocatalyst and the non-photosensitive source of reducible silver ions must be in catalytic proximity (that is reactive association). "Catalytic proximity" or "reactive association" means that they should be in the same layer or in adjacent layers. It is preferred that these reactive components be present in the same emulsion layer.

The source of non-photosensitive reducible silver ions is preferably present in an amount of about 5% by weight to about 70% by weight, and more preferably, about 10% to about 50% by weight, based on the total dry weight of the emulsion layers. Stated another way, the amount of reducible silver ions is generally present in an amount of from about 0.001 to about 0.2 mol/m$^2$ of material, and preferably from about 0.01 to about 0.05 mol/m$^2$ of material. As noted above, mixtures of silver sources can be used.

The total amount of silver (from all silver sources) in the photothermographic materials is generally at least 0.002 mol/m$^2$, and preferably from about 0.01 to about 0.05 mol/m$^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.).

In some instances, the reducing agent composition comprises two or more components such as a hindered phenol developer and a co-developer that can be chosen from the various classes of reducing agents described below. For example, hindered phenol developers may be used in combination with hydrazine, sulfonyl hydrazide, trityl hydrazide, formyl phenyl hydrazide, 3-heteroaromatic-substituted acrylonitrile, and 2-substituted malondialdehyde co-developer compounds described below. Ternary developer mixtures involving the further addition of contrast enhancing agents such as hydrogen atom donor, hydroxylamine, alkanolamine, ammonium phthalamate, hydroxamic acid, and N-acylhydrazine compounds are also useful.

Hindered phenol reducing agents are preferred (alone or in combination with one or more co-developers). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis(hydroxyphenyl)methanes, hindered phenols, and hindered naphthols each of which may be variously substituted.

Representative binaphthols include but are not limited to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include but are not limited to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include but are not limited to 4,4'-methylenebis(2-methyl-1-naphthol). For additional compounds see U.S. Pat. No. 5,262,295 (noted above).

Representative bis(hydroxyphenyl)methanes include but are not limited to bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol) and 2,2-bis(3,5-dimethyl-4-hydroxyphenyl)propane. For additional compounds see U.S. Pat. No. 5,262,295 (noted above).

Representative hindered phenols include but are not limited to 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include but are not limited to 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example 4-hydroxy-3,5-dimethoxybenzaldehydrazine), a combination of aliphatic carboxylic acid aryl hydrazides and ascorbic acid, such as 2,2'-bis(hydroxymethyl)propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-bin aphthyl, 6,6'-dibromo-2,2'-dihydroxy-1,1'- binaphthyl, and bis(2-hydroxy-1-naphthyl)methane], a combination of bis-o-naphthol and a 1,3-dihydroxybenzene derivative (for example 2,4-dihydroxybenzophenone or 2,4-dihydroxyacetophenone), 5-pyrazolones such as 3-methyl-1-phenyl-5-pyrazolone, reductones (such as dimethylamino-hexose reductone, anhydrodihydro-amino-hexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), bisphenols [such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol) and 2,2-bis(3,5-dimethyl-4-hydroxyphenyl)propane], ascorbic acid derivatives (such as 1-ascorbylpalmitate, ascorbylstearate and unsaturated aldehydes and ketones), 3-pyrazolidones, and certain indane-1,3-diones.

Still other useful reducing agents are described for example in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.).

The reducing agent (or mixture thereof) described herein is generally present as 1 to 20% (dry weight) of the emulsion layer. In multilayer constructions, if the reducing agent is added to a layer other than an imaging layer, slightly higher proportions, of from about 2 to 25 weight % may be more desirable. Any co-developers may be present generally in an amount of from about 0.01% to about 1.5% (dry weight) of the imaging layer coating.

High Contrast Agents

The thermographic and photothermographic materials of this invention include one or more high contrast agents. Such materials are sometimes identified as "co-developers" or "auxiliary developers", but their main function is to increase the contrast of the material by reducing most or all of the reducible silver ions in the non-photosensitive source of reducible silver ions in the radiation-exposed areas (that is in the latent image).

High contrast agents that are particularly useful in the materials of this invention include, but are not limited to, acrylonitrile co-developers, hydrazide co-developers and isoxazole co-developers.

For example, useful acrylonitrile co-developers can be represented by Formula I as follows:

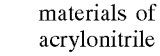

$$H(R')C{=}C(R)CNI$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo atom (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,654,130 (Murray), both incorporated herein by reference.

Examples of such compounds include, but are not limited to, the compounds identified as HET-01 and HET-02 in U.S. Pat. No. 5,635,339 (noted above) and MA-01 through MA-07 in U.S. Pat. No. 5,654,130 (noted above)

Other useful high contrast agents are hydrazide co-developers having the following Formula II:

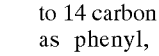

$$R_1(CO)\text{—}NHNH_2 \qquad \text{II}$$

wherein $R_1$ is a substituted or unsubstituted aliphatic group having up to 20 carbon atoms. Useful aliphatic groups include, but are not limited to, alkyl group of 1 to 20 carbon atoms (linear or branched, and preferably from 1 to 10 carbon atoms, and more preferably from 1 to 5 carbon atoms including methyl, ethyl, isopropyl, t-butyl and n-pentyl groups), a substituted or unsubstituted alkenyl group of 2 to 20 carbon atoms (linear or branched, and preferably from 2 to 10 carbon atoms, and more preferably from 2 to 5 carbon atoms such as 1-ethenyl, 2-propenyl, isopropenyl and 2-n-pentenyl groups) , and a substituted or unsubstituted alkoxy or thioalkoxy group of 1 to 20 carbon atoms (linear or branched, and preferably 1 to 10 carbon atoms and more preferably from 1 to 5 carbon atoms). $R_1$ can also be a carbocyclic or heterocyclic group, each of which can be substituted. Useful carbocyclic groups are substituted or unsubstituted aryl, aryalkyl or alkaryl groups having 6 to 14 carbon atoms in the ring structure (such as phenyl, naphthyl, p-methylphenyl and benzyl groups), a substituted or unsubstituted aryloxy or thioaryloxy group of 6 to 14 carbon atoms in the ring structure (such as phenoxy and naphthoxy groups), and useful heterocyclic groups include substituted or unsubstituted aromatic or non-aromatic heterocyclic groups having up to 10 carbon, nitrogen, sulfur and oxygen atoms in the single or fused ring structure, a substituted or unsubstituted carbocyclyl group of 5 to 14 carbon atoms in the nonaromatic ring structure, an amido group having up to 20 carbon atoms, a substituted or unsubstituted anilino group having up to 20 carbon atoms, and $R_3$ is a trityl group. Further details of such compounds, including methods of making them, are provided in U.S. Pat. No. 5,558,983 (Simpson et al.), incorporated herein by reference.

Useful compounds within Formula II include, but are not limited to those identified as CA-1 through CA-6 in U.S. Pat. No. 5,558,983 (noted above).

Still other useful hydrazide co-developer high contrast agents have the following Formula III:

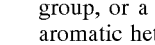

$$R_2\text{—}(C{=}O)\text{—}NHNH\text{—}R_3 \qquad \text{III}$$

wherein $R_2$ is hydrogen and $R_3$ is a substituted or unsubstituted aryl group of 6 to 14 carbon atoms in the ring structure (such as phenyl, naphthyl, anthryl, p-methylphenyl, o-chlorophenyl groups).

Alternatively, $R_2$ is hydrogen, a substituted or unsubstituted alkyl group of 1 to 20 carbon atoms (linear or branched, and preferably from 1 to 10 carbon atoms, and more preferably from 1 to 5 carbon atoms including methyl, ethyl, isopropyl, t-butyl and n-pentyl groups), a substituted or unsubstituted alkenyl group of 2 to 20 carbon atoms (linear or branched, and preferably from 2 to 10 carbon atoms, and more preferably from 2 to 5 carbon atoms such as 1-ethenyl, 2-propenyl, isopropenyl and 2-n-pentenyl groups) , a substituted or unsubstituted alkoxy or thioalkoxy group of 1 to 20 carbon atoms (linear or branched, and preferably 1 to 10 carbon atoms and more preferably from 1 to 5 carbon atoms), a substituted or unsubstituted aryl, aryalkyl or alkaryl group having 6 to 14 carbon atoms in the ring structure (such as phenyl, naphthyl, p-methylphenyl and benzyl groups), a substituted or unsubstituted aryloxy or thioaryloxy group of 6 to 14 carbon atoms in the ring structure (such as phenoxy and naphthoxy groups), a substituted or unsubstituted aromatic or non-aromatic heterocyclyl group having up to 10 carbon, nitrogen, sulfur and oxygen atoms in the single or fused ring structure, a substituted or unsubstituted carbocyclyl group of 5 to 14 carbon atoms in the nonaromatic ring structure, an amido group having up to 20 carbon atoms, a substituted or unsubstituted anilino group having up to 20 carbon atoms, and $R_3$ is a trityl group. Further details of such compounds, including methods of making them, are provided in U.S. Pat. No. 5,496,695 (Simpson et al.) and U.S. Pat. No. 5,545,505 (Simpson et al.), both incorporated herein by reference.

Representative compounds of Formula III include, but are not limited to, the compounds identified as H-1 through H-28 in U.S. Pat. No. 5,496,695 and the compounds identified as H-1 through H-29 in U.S. Pat. No. 5,545,505.

Still another class of useful high contrast agents includes hydrazide co-developers having the following Formula IV:

$$R_4—CO—NHNH—SO_2R_5 \qquad \text{IV}$$

wherein $R_4$ and $R_5$ are independently a substituted or unsubstituted alkyl group of 1 to 20 carbon atoms (linear or branched, and preferably from 1 to 10 carbon atoms, and more preferably from 1 to 5 carbon atoms including methyl, ethyl, isopropyl, t-butyl and n-pentyl groups), a substituted or unsubstituted alkenyl group of 2 to 20 carbon atoms (linear or branched, and preferably from 2 to 10 carbon atoms, and more preferably from 2 to 5 carbon atoms such as 1-ethenyl, 2-propenyl, isopropenyl and 2-n-pentenyl groups) , a substituted or unsubstituted alkoxy group of 1 to 20 carbon atoms (linear or branched, and preferably 1 to 10 carbon atoms and more preferably from 1 to 5 carbon atoms), a substituted or unsubstituted aryl group having 6 to 14 carbon atoms in the ring structure (such as phenyl, naphthyl, p-methylphenyl and o-chlorophenyl groups), a substituted or unsubstituted aryloxy group of 6 to 14 carbon atoms in the ring structure (such as phenoxy and naphthoxy groups), a substituted or unsubstituted aromatic or nonaromatic heterocyclyl group having up to 10 carbon, nitrogen, sulfur and oxygen atoms in the single or fused ring structure, or a substituted or unsubstituted carbocyclyl group of 5 to 14 carbon atoms in the nonaromatic ring structure. Additional details of these compounds, including their preparation and representative cyclic groups useful as $R_4$ or $R_5$, are provided in U.S. Pat. No. 5,464,738 (Lynch et al.), incorporated herein by reference.

Representative compounds within Formula IV include, but are not limited to, the compounds identified as Sulfonyl Hydrazide Developers 1–12 of U.S. Pat. No. 5,464,738 (noted above).

Still other useful co-developer reducing agents are described for example in copending and commonly assigned U.S. Ser. No. 09/239,182 (filed Jan. 28, 1999 by Lynch and Skoog). These compounds are generally defined as having the following formula:

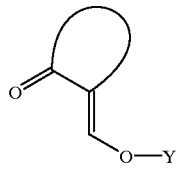

wherein Y is H, a metal cation (such as zinc ion, ammonium ion, alkali metals, alkaline earth metals but preferably, sodium or potassium), or an alkyl group (preferably, an alkyl group having from 1 to 4 carbon atoms, and more preferably, a methyl or ethyl group), and the solid curved line represents the atoms and bonds necessary to complete a 5- to 6-membered carbocyclic or heterocyclic main ring structure that may include heteroatoms (for example nitrogen, oxygen and sulfur). The main ring structure can include one or more additional rings, including pendant and fused rings.

Of all of the possible high contrast agents that can be used in the materials of this invention, the most preferred compounds are formyl phenyl hydrazine, trityl hydrazide and various alkali metal salts of alkyl(hydroxymethylene) cyanoacetates (identified below in Examples 1–6). The most preferred high contrast agent is a potassium salt of ethyl (hydroxymethylene)cyanoacetate.

Mixtures of the same or different type of high contrast agents can be used in the photothermographic materials of this invention.

The one or more high contrast agents are present in the photothermographic materials of this invention in an amount of at least 0.001 $g/m^2$, and preferably in an amount of at least 0.01 $g/m^2$. The upper limit is generally determined by practical considerations of cost, amount of activity desired, structure and activity and is generally 1 $g/m^2$.

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials of the present invention can be further protected against the production of fog and can be stabilized against loss of sensitivity during storage. While not necessary for the practice of the invention, it may be advantageous to add a mercury (II) salt to the imaging layer(s) as an antifoggant. Preferred mercury (II) salts for this purpose are mercuric acetate and mercuric bromide.

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), mercury salts as described in U.S. Pat. No. 2,728,663 (Allen), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460, 938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.) and U.S. Pat. No. 5,300,420 (Kenney et al.).

In addition, certain sulfonyl-substituted derivatives of benzotriazoles (for example alkylsulfonylbenzotriazoles and arylsulfonylbenzotriazoles) have been found to be useful stabilizing compounds (such as for post-processing print stabilizing), as described in copending and commonly assigned U.S. Ser. No. 09/301,652 (filed Apr. 28, 1999 by Kong, Sakizadeh, LaBelle, Spahl and Skoug), incorporated herein by reference.

Furthermore, specific useful antifoggants/stabilizers have the general structure:

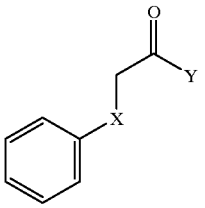

wherein X is —O— or —S—, and Y is —$NH_2$, —OH, or —$O^-M^+$ wherein $M^+$ is a metal atom, can be included in the imaging layers of the materials. These compounds and their use are described in more detail in U.S. Pat. No. 6,083,861 (Lynch et al.), incorporated herein by reference.

Other antifoggants are hydrobromic acid salts of heterocyclic compounds (such as pyridinium hydrobrornide perbromide) as described for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described for example in U.S. Pat. No. 4,784,939 (Pham), substituted propenitrile compounds as described for example in U.S. Pat. No. 5,686,228 (Murray et al.), silyl blocked compounds as described for example in U.S. Pat. No. 5,358,843 (Sakizadeh et al.), vinyl sulfones as described for example in EP-A-0 600,589 (Philip, Jr. et al.), and EP-A-0 600,586 (Philip, Jr. et al.) and tribromomethylketones as described for example in EP-A-0 600,587 (Oliff et al.).

Preferably, the photothermographic materials of this invention include one or more polyhalo antifoggants that include one or more polyhalo substituents including but not limited to, dichloro, dibromo, trichloro and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or into an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include but are not limited to phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as cobaltic hexamine trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof, phthalazinone and phthalazinone derivatives, or metal salts or these derivatives [such as 4-(1-naphthyl) phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto- 1 ,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Binders

The photocatalyst (such as photosensitive silver halide), the non-photosensitive source of reducible silver ions, the reducing agent composition, and any other additives used in the present invention are generally mixed with one or more binders that are either hydrophilic or hydrophobic. Thus, either aqueous or solvent based formulations can be used to prepare materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable polyvinyl butyral binders are available as BUTVAR® B79 (Solutia, Inc.) and Pioloform BS-18 or Pioloforn BL-16 (Wacker Chemical Company).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols and polysaccharides (such as dextrans and starch ethers).

Hardeners for various binders may be present if desired. Useful hardeners are well known and include diisocyanate compounds as described for example in EP-0 600 586 B1 and vinyl sulfone compounds as described in EP-0 600 589 B1.

Where the proportions and activities of the photothermographic materials require a particular developing time and temperature, the binder(s) should be able to withstand those conditions. Generally, it is preferred that the binder not decompose or lose its structural integrity at 120° C. for 60 seconds, and more preferred that it not decompose or lose its structural integrity at 177° C. for 60 seconds.

The polymer binder(s) is used in an amount sufficient to carry the components dispersed therein that is within the effective range of the action as the binder. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which they are included.

Support Materials

The photothermographic materials of this invention comprise a polymeric support that is preferably a flexible, transparent film that has any desired thickness and is composed of one or more polymeric materials depending upon their use. The supports are generally transparent (especially if the material is to be used as a photomask) or at least translucent, but in some instances, opaque supports may be useful. They are required to exhibit dimensional stability during development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonate, and polystyrenes (including polymers of styrene derivatives). Preferred supports are composed of polymers having good heat stability, such as polyesters and polycarbonate. Polyethylene terephthalate film is the most preferred support. Various support materials are described, for example, in *Research Disclosure* August 1979, item 18431.

Opaque supports can also be used including dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials including vinylidene halide polymers.

Barrier Layer

The photothermographic materials of this invention include at least one "barrier" layer that is on the same side of the support as the imaging layer(s). This barrier layer is preferably in direct contact with the imaging layer(s), but it can be separated from them by an interlayer through which fogging agents (that is, by-products from thermal imaging) may diffuse. Alternatively, the barrier layer can be the outermost layer of the material, or it can be situated between the imaging layer(s) and an outermost protective layer.

The barrier layer includes one or more film-forming polymers that are impermeable to or reactive with fogging agents or other low molecular weight by-products that are released from the high contrast agent(s) during heat development of the photothermographic materials. Such fogging agents are generally released at 80° C. or higher. Although not wishing to be bound by theory, applicants believe that one common fogging agent or by-product of this type is formic acid. Other fogging agents or by-products that could be formed by reactions or decompositions of the hydrazine materials, include hydrazine, hydrazo, diimide, and azo compounds. Additionally, the barrier layer may also prevent diffusion of water into the silver-containing emulsion or imaging layer(s). The diffusion of water is undesirable as it is believed to accelerate the rate of formation of formic acid.

Before describing the specific polymer materials that have been found useful as barrier layer materials, it would be useful for a skilled worker to understand how potentially useful barrier layer materials can be identified. As noted above, useful barrier layer materials must have good film forming properties. In addition, these potential barrier layer materials must not adversely affect the conventional sensitometric properties expected from photothermographic materials. For example, such useful barrier materials must not cause unacceptable fogging, reduced speed, decreased contrast, or increased $D_{min}$.

Once it has been found that the potential barrier materials do not adversely affect sensitometric properties, those materials can then be coated in a barrier layer formulation and evaluated for their ability to reduce migration or diffusion of a common by-product, for example formic acid, hydrazo compounds, azo compounds, diimide compounds, or hydrazine compounds. This evaluation can be done using the procedures described in the Examples noted below.

It would also be apparent to one skilled in the art that optimization of a given barrier layer would require routine experimentation to determine the best barrier layer material (s) for a given high contrast agent in the photothermographic material. It may also require some routine experimentation to determine whether relatively hydrophilic or hydrophobic polymer materials should be used, or if a mixture of polymers should be used because the nature of the polymers might affect their ability to inhibit diffusion of certain by-products. In addition, the thickness of the barrier layer may be varied depending upon the type of polymer(s) used therein and the particular concentration of by-product(s) that must be stopped. Typically, most barrier layers in the photothermographic materials of this invention should have a minimum dry thickness of 0.1 $\mu$m (preferably a minimum thickness of 0.5 $\mu$m).

Thus, this application is not intended to provide all of the details for a skilled worker to know the optimum conditions for each barrier layer polymer(s) and each possible high contrast agent. Rather, with the general teaching and the specific embodiments illustrated below in the Examples, it would be well within the purview of a skilled artisan to achieve the desired optimization for a given photothermographic material of this invention.

Particularly useful barrier layer materials include, but are not limited to, polyvinyl alcohol, polymers derived from styrene or derivatives thereof, polymers derived from a vinyl halide, vinyl acetate, water-soluble or water-dispersible polyesters, gelatin or gelatin derivatives and polyvinyl pyrrolidones. These materials can be obtained from a number of commercial sources. It is to be understood that as used herein, the term "polymer" is meant to refer to homopolymers, copolymers, terpolymers and other reaction products of multiple monomeric starting materials.

Some more particularly useful polymer barrier layer materials include polyvinyl alcohol, a styrene polymer (including polymers of styrene derivatives), a vinyl halide polymer, a vinyl acetate polymer [such as polyvinyl acetate, poly(ethylene-co-vinyl acetate) or a copolymer of a vinyl halide and vinyl acetate] , a polyvinyl pyrrolidone, a water-soluble or water-dispersible polyester, and gelatin (including deionized and acid processed gelatin) or a gelatin derivative (such as phthalated gelatin and carbamoylated gelatin. Of these polymers, the styrene polymers, vinyl acetate polymers and polyvinyl alcohol are preferred.

Polystyrenes are preferred hydrophobic polymers for use in barrier layers. Of the polystyrenes, (including copolymers) those having a molecular weight greater than 100,000 are preferred.

Of the relatively hydrophilic binder materials, polyvinyl alcohols are preferred, and polyvinyl alcohols having at least 88% hydrolysis are most preferred.

Additional useful film-forming polymers that can be used in barrier layers according to this invention are those having epoxy functionality as described in copending and commonly assigned U.S. Ser. No. 09/729,256, filed on even date herewith by Miller, Horch, Bauer, and Teegarden and entitled "Thermally-Developable Imaging Materials Containing Surface Barrier Layer". Such polymers include homopolymers and copolymers prepared from glycidyl acrylate, glycidyl methacrylate, and allyl glycidyl ether. These polymers can be used alone or in admixture with other film-forming polymers including those described above and cellulosic materials. Particularly useful film-forming polymers of this type include but are not limited to, poly(glycidyl methacrylate), poly(glycidyl methacrylate-co-ethyl methacrylate), poly(glycidyl methacrylate-co-methyl methacrylate), poly(glycidyl methacrylate-co-ethyl methacrylate-co-methyl methacrylate), poly(glycidyl acrylate-co-ethyl methacrylate), poly(glycidyl methacrylate-co-isopropyl methacrylate), poly(allyl glycidyl ether-co-n-butyl acrylate), poly(glycidyl methacrylate-co-glycidyl acrylate-co-methyl methacrylate), and poly(glycidyl acrylate-co-allyl glycidyl ether-co-styrene).

In such instances, the adhesion of the barrier layer to underlying layers can be enhanced by a judicious choice of barrier layer polymers and/or additives. This choice would be readily apparent from routine experimentation with a given underlayer. For example, it has been found that adhesion of barrier layers to underlying conventional photothermographic emulsions can be enhanced by the incorporation of a matting agent in the barrier layer (up to 80 weight % and preferably from about 10 to about 20 weight %). Particularly useful matting agents include, but are not limited to, colloidal silica, zinc oxide and any other conventional matting agent that does not adversely affect the properties of the resulting photothermographic materials.

A particularly useful barrier layer comprises polyvinyl alcohol and colloidal silica (up to 20 weight %).

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone, acetone or tetrahydrofuran. Methods of making such formulations are described for example in U.S. Pat. No. 5,275,927 (Pham et al.), U.S. Pat. No. 5,422,234 (noted above), and U.S. Pat. No. 5,928,857 (Geisler et al.), all or which are incorporated herein by reference.

For aqueous-based formulations, the components of the emulsion layer(s) are dissolved or dispersed within water or mixtures of water and various water-miscible polar organic solvents such as alcohols. Methods of making such formulations are described for example in U.S. Pat. No. 5,891,616 (Gilliams et al.), U.S. Pat. No. 6,030,765 (Leenders et al.), and EP-A-0 803,764 (Katoh et al.), all of which are incorporated herein by reference.

Photothermographic materials can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn) in various layers for conventional purposes. Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by treating the support, adding matting agents to the topcoat to provide a certain amount of haze, using acutance dyes in certain layers, or other procedures described in the noted publication.

The photothermographic materials can include antistatic or conducting layers. Such layers may contain soluble salts (for example chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electro-conductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials may also contain electro-conductive underlayers to reduce static electricity effects and improve transport through processing equipment. Such layers are described in U.S. Pat. No. 5,310,640 (Markin et al.).

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

The imaging formulation can be comprised of two or more layers. For example, two-layer constructions (having two distinct layers on the frontside of the support) can contain photocatalyst and non-photosensitive source of reducible silver ions in one emulsion layer (usually the layer adjacent to the support) and the reducing composition and other ingredients in a second layer or distributed between both layers. If desired, the developer and co-developer may be in separate layers.

Layers to promote adhesion of one layer to another in photothermographic materials are also known, as described for example in U.S. Pat. No. 5,891,610 (Bauer et al.), U.S. Pat. No. 5,804,365 (Bauer et al.) and U.S. Pat. No. 4,741,992 (Przezdziecki). Adhesion can also be promoted using specific polymeric adhesive materials is adhered layers as described for example in U.S. Pat. No. 5,928,857 (Geisler et al.).

Photothermographic formulations described can be coated by various coating procedures including wire wound rod coating, dip coating, air knife coating, curtain coating, slide coating or extrusion coating using hoppers of the type described in U.S. Pat. No. 2,681,294 (Beguin). Layers can be coated one at a time or simultaneously. It is preferred that two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.) and GB 837,095 (Ilford). Atypical coating gap for the emulsion layer can be from about 10 to about 750 $\mu$m, and the layer can be dried in forced air at a temperature of from about 20° C. to about 150° C. It is preferred that the thickness of the layer be selected to provide maximum image densities greater than about 0.2, more preferably greater than 3.0 and most preferably greater than 5.0, as measured by a commercially available X-Rite Model 361T Densitometer.

When the layers are coated simultaneously using various coating techniques, a "carrier" layer formulation comprising a single-phase mixture of the two or more polymers described above may be used. Such formulations are described in copending and commonly assigned U.S. Ser. No. 09/510,648 (filed Feb. 23, 2000 by Ludemann, LaBelle, Geisler, Warren, Crump and Bhave) that is based on Provisional Application No. 60/121,794, filed Feb. 26, 1999.

Mottle and other surface anomalies can be reduced in the materials of this invention by incorporation of a fluorinated polymer as described for example in U.S. Pat. No. 5,532,121 (Yonkonski et al.) or by using particularly drying techniques as described for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, the method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention include emulsion layers on both sides of the support.

Photothermographic materials according to the present invention can comprise one or more layers containing one or more acutance and/or antihalation dyes. These dyes are chosen to have absorption close to the exposure wavelength and are designed to absorb scattered light. One or more antihalation dyes may be incorporated into one or more antihalation layers according to known techniques as an antihalation backing layer, an antihalation underlayer or as an overcoat. It is preferred that the photothermographic materials of this invention contain an antihalation coating on the support opposite to the side on which the emulsion and topcoat layers are coated.

To promote image sharpness, one or more acutance dyes may be incorporated into one or more frontside layers such as the photothermographic emulsion layer or topcoat layers according to known techniques. Dyes particularly useful as antihalation and acutance dyes include dihydroperimidine squaraine dyes having a nucleus represented by the following structure:

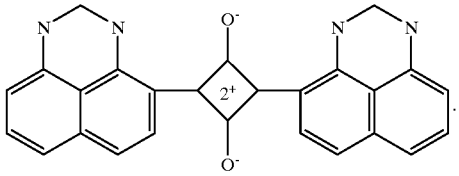

Details of such dyes having the dihydro-perimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenedylium, 1,3-bis[2,3-dihydro-2,2-bis[[1-oxohexyl)oxy]methyl]-1H-perimidin-6-yl]-2,4-dihydroxy-, bis(inner salt).

Dyes particularly useful as antihalation dyes on the backside of the photothermographic materials also include indolenine cyanine dyes having the nucleus represented by the following general structure:

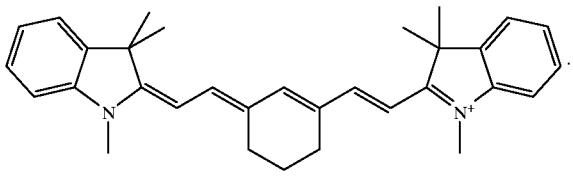

Details of such antihalation dyes having the indolenine cyanine nucleus and methods of their preparation can be found in EP-A-0 342 810 (Leichter), incorporated herein by reference. One particularly useful cyanine dye , compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]-ethenyl]-1,3,3-trimethyl-, perchlorate.

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP 0 911 693 Al (Sakurada et. al.).

In one preferred photothermographic material, the antihalation layer comprises a binder and cyclobutenediylium, 1,3-bis[2,3-dihydro-2,2-bis[[1-oxohexyl)oxy]methyl]-1H-perimidin-6-yl]-2,4-dihydroxy-, bis(inner salt) as an antihalation dye.

In another preferred photothermographic material, the antihalation layer comprises a binder and 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate as an antihalation dye.

Imaging/Development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 300 to about 850 nm.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including Research Disclosure, Vol. 389, Publication 38957, September 1996 (such as sunlight, xenon lamps and fluorescent lamps). Particularly useful exposure means are laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using of the materials of this invention, development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to about 200° C., and more preferably from about 100 to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent. The second heating step prevents further development.

Use as a Photomask

The photothermographic materials of the present invention are sufficiently transmissive in the range of from about 350 to about 450 nm in nonimaged areas to allow their use in a process where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as, for example, a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner. Unless otherwise indicated, all materials are commercially available from one or more sources.

EXAMPLES 1–6

All photothermographic materials evaluated in this example were prepared by coating a photothermographic formulation prepared as follows:

Photothermographic Formulation

An emulsion of silver behenate full soap (containing a mixture of silver behenate, silver arachidate and silver stearate) containing preformed silver halide grains (see U.S. Pat. No. 5,939,249 of Zou, incorporated herein by reference) was homogenized to 23% solids in methyl ethyl ketone (MEK) in 1.5% polyvinyl butyral (BUTVAR® B-79, Solutia, Inc.). To 200 g of this dispersion (held at 21° C.) was added pyridinium hydrobromide perbromide (0.23 g) with stirring. After 60 minutes of mixing, a 10% (by weight) calcium bromide solution (0.5 ml) in methanol was added. Stirring was continued and a 10% (by weight) zinc bromide solution (1.5 ml) in methanol was added after 5 minutes. After another 30 minutes, 2-mercapto-5-methylbenzimidazole (0.14 g), 3-ethyl-2-[[7-[[3-ethyl-5-(methylthio)-2(3H)-benzothiazolylidene]methyl]-4,4a,5,6-tetrahydro-2(3H)-naphthalenylidene]-methyl]-5-(methylthio)benzothiazolium iodide (0.0067 g) and 2-(4-chlorobenzoyl)benzoic acid (2.61 g) were added to the dispersion in methanol (6 g). The temperature of the dispersion was reduced to 10° C. after stirring for 60 minutes. After stirring for an additional 30 minutes, additional BUTVAR® B-79 polyvinyl butyral (45 g) was added with mixing. The imaging formulation was completed by mixing for 15 minutes between the following additions:

- 2-Tribromomethylsulfonylquinoline antifoggant (1.3 g),
- Isocyanate hardening agent (DESMODUR N3300, Bayer Chemicals, 0.4 g),
- Tetrachlorophthalic acid (0.36 g),
- 4-Methylphthalic acid (0.53 g),
- 1,1-Bis(2-hydroxy-3,5-dimethylphenyl)-3,5,5-trimethylhexane (NONOX or PERMANAX WSO, St-Jean PhotoChemicals, Inc., Quebec, 10.6 g), and High contrast agent identified in Stress Processing Test below (0.778 mmol.)

The imaging formulation was coated onto a 7 mil (178 μm) polyethylene terephthalate support and dried at 86° C. for 5 minutes to form an imaging layer.

Topcoat Formulation

Over this imaging layer was applied a protective topcoat as identified below at 4 mil (102 μm) wet thickness and dried at 86° C. for 5 minutes. After imaging and heat development, these photothermographic materials were evaluated for migration of fogging agents from the imaging layer. Initial sensitometry, stress processing, shelf stability and adhesion were also evaluated.

Three tests were developed that are capable of detecting fogging agent migration in photothermographic imaging layers containing a high contrast agent. These tests used edge sharpness, processing with a polyester seal over the imaging layer, and the fogging action of the fogging agent (by-product from thermal development) after migration into non-imaged areas of the imaging layer. These tests are very sensitive to the migration of the fogging agent.

The Control A photothermographic material comprised a protective topcoat comprised of 15 g of cellulose acetate butyrate (CAB 171-15S, Eastman Chemicals) and 0.26 g of vinyl sulfone dissolved in 183 g of MEK. (Vinyl Sulfone is compound VS-1 described in EP 0 600 589B1.) The photothermographic materials of the invention (Examples 1–6) however had a protective topcoat comprised of polyvinyl alcohol and colloidal silica (50 weight %).

Unless otherwise noted below, all of the photothermographic materials evaluated herein were imagewise exposed using a conventional IR laser and heat developed at 124° C. for 15 seconds.

Edge Sharpness Evaluation Test

The "edge sharpness test" includes a measurement of the "line width" of an imaged material. A control material, Control B, was made by sealing an imagewise exposed strip of a photothermographic material with a 7 mil (178 μm) polyester film during heat development to prevent migration of fogging agents and subsequent image spread. This test measures the image spread due to the fogging agent (believed to be formic acid) migrating through the protective topcoat, subsequently migrating back through the topcoat into the imaging layer and developing silver adjacent to the developed silver. A wide "line width" indicates a poor barrier to fogging agent migration.

| Material | Line Width (cm) |
|---|---|
| Control A | 0.40 |
| Control B | 0.16 |
| Example 1 | 0.16 |

The Control A and Invention materials behaved significantly differently when used over imaging formulations having different "thermal reactivity" (controlled by the amount of high contrast agent). The Invention barrier layer provided the desired results independently of thermal reactivity.

| Material | Reactivity | Line Width (cm) |
|---|---|---|
| Control A | low | 0.16 |
| Control A | medium | 0.32 |
| Control A | high | 0.40 |
| Example 1 | low | 0.16 |
| Example 1 | medium | 0.16 |
| Example 1 | high | 0.16 |

Fogging by Fogging Agent Test

Samples of the photothermographic materials were cut into 71 cm×10 cm strips. The samples were exposed to red light over a 51 cm×10 cm area and the rest of the samples were left unexposed ("unexposed area"). Samples were developed on a conventional DryView™ BSU Processor. The amount of fogging caused by the diffusion of fogging agent into the unexposed areas was evaluated by measuring the percent of the unexposed areas that were imaged during heat development. The results are as follows:

| Material | % Fogged |
|---|---|
| Control A | 100% |
| Example 1 | 0% |

Polyester Seal Test

A polyester seal was formed on imaged samples of the photothermographic materials by laying a strip of 7 mil (178 μm) polyethylene terephthalate film onto the top of the material prior to heat development in an attempt to prevent migrating fogging agent from escaping into the environment. The air pockets between the photothermographic material and the polyester seal were left intact since these pockets may be filled with migrating fogging agent that fogs the silver in the air pockets. This phenomenon occurs only when an air pocket overlaps a exposed area and an unexposed area. The air pockets are clearly observed after processing and those that overlap both exposed and unexposed regions can be examined for fogging. The results are reported as the percentage of overlapping air pockets that are fogged by migrating fogging agent. The results are obtained from a photothermographic formulation using various high contrast agents (see below).

| Material | % Fogging |
|---|---|
| Control A | 100% |
| Example 1 | 0% |

Stress Processing Test

These experiments were carried out using the Control A photothermographic material as well as Examples 1–6 materials of this invention. The stress processing test was carried out by heating the materials at 124° C. for 25 seconds rather than the standard 15 seconds. The various high contrast agents used in the materials were as follows:

Control A Potassium salt of ethyl(hydroxymethylene) cyanoacetate

Example 1 Same as for Control A

Example 2 Potassium salt of methyl(hydroxymethylene) cyanoacetate

Example 3 Sodium salt of methyl(hydroxymethylene) cyanoacetate

Example 4 Sodium salt of t-butyl(hydroxymethylene) cyanoacetate

Example 5 Sodium salt of benzyl(hydroxymethylene) cyanoacetate

Example 6 Same as for Example 2

The following results show excellent initial sensitometry before the stress test for the materials of this invention.

| Material | $D_{min}$ | $D_{max}$ | Speed* | Contrast A** | Contrast D*** |
|---|---|---|---|---|---|
| Control A | 0.064 | 4.791 | 2.14 | 3.517 | 44.385 |
| Control A$ | 0.082 | 4.912 | 2.33 | 1.043 | 27.800 |
| Example 1 | 0.067 | 4.705 | 2.07 | 3.034 | 41.398 |
| Example 1$ | 0.073 | 4.793 | 2.21 | 3.020 | 38.933 |
| Example 2 | 0.065 | 4.647 | 1.98 | 3.327 | 36.934 |
| Example 2$ | 0.069 | 4.710 | 2.12 | 3.379 | 37.159 |
| Example 3 | 0.065 | 4.627 | 2.07 | 3.402 | 34.955 |
| Example 3$ | 0.069 | 4.823 | 2.21 | 2.626 | 35.747 |
| Example 4 | 0.065 | 4.750 | 1.94 | 3.434 | 44.303 |
| Example 4$ | 0.075 | 4.829 | 2.08 | 2.604 | 41.020 |
| Example 5 | 0.072 | 4.418 | 2.08 | 3.471 | 32.749 |
| Example 5$ | 0.084 | 4.501 | 2.33 | 1.026 | 25.807 |
| Example 6 | 0.088 | 4.858 | 2.07 | 2.223 | 39.545 |
| Example 6$ | 0.088 | 4.858 | 2.22 | 2.223 | 24.640 |

$Stressed samples

*Speed measured as 4-log[energy required for a density of 3 above $D_{min}$].

**Contrast A measured as the slope of the D v. log E curve between 0.07 and 0.7 above $D_{min}$.

***Contrast D measured as the slope of the D v. log E curve between 1 and 3 above $D_{min}$.

Shelf Stability Test

The shelf stability test was carried out by storing samples of the photothermographic materials at 21° C. and 50% relative humidity. The results are shown below, indicate that photothermographic materials incorporating barrier layers of this invention exhibit improved $D_{min}$ and exposure latitude upon storage.

| Material | $D_{min}$ | $D_{max}$ | SPD#3* | Con A** | Con D*** |
|---|---|---|---|---|---|
| Control A | 0.064 | 4.791 | 2.14 | 3.517 | 44.385 |
| Control A# | 3.370 | 5.073 | — | — | — |
| Example 1 | 0.066 | 4.681 | 2.06 | 3.325 | 40.802 |
| Example 1# | 0.727 | 4.924 | 2.55 | 1.930 | 4.410 |
| Example 2 | 0.065 | 4.647 | 1.98 | 3.327 | 36.934 |
| Example 2# | 0.115 | 4.831 | 2.34 | 1.380 | 21.112 |
| Example 3 | 0.065 | 4.627 | 1.98 | 3.402 | 34.955 |
| Example 3# | 0.118 | 4.716 | 2.42 | 0.581 | 13.476 |
| Example 4 | 0.080 | 4.354 | 2.07 | 3.232 | 31.522 |
| Example 4# | 0.139 | 4.279 | 2.43 | 0.946 | 11.159 |
| Example 6 | 0.068 | 4.788 | 2.07 | 3.224 | 39.545 |
| Example 6# | 0.114 | 4.750 | 2.33 | 1.387 | 17.632 |

*SPD#3 is speed measured as described for the previous examples.

#After 4-month storage for Control A, and 8-month storage for the materials of this invention.

Examples 7–13

Additional polymers were evaluated as part of barrier layers and were coated over the topcoat layer in photothermographic materials designed like those used for Examples 1–6.

An imaging formulation was prepared as follows:

A preformed soap homogenate (152.888 g at 27.56% solids, 1.3474% BUTVAR® B-79 polyvinyl butyral, 26.2126% preformed soap like that described in U.S. Pat. No. 5,939,249 noted above) was added to a glass jar. The dispersion was stirred at a constant rate of 500 rpm using a pitched blade impeller at 21° C. To this dispersion was added the following components in the noted order:

Pyridinium hydrobromide perbromide (2.216 g) in methanol (6.632 g), 0.885 g of solution, Zinc bromide (2.508 g) in methanol (6.677 g), 0.918 g of solution, BUTVAR® B-79 polyvinyl butyral (0.985 g), Solution (11.136 g) containing 2-(p-chlorobenzoyl) benzoic acid (20.207 g), 3-ethyl-2-[[7-[[3-ethyl-5-(methylthio)-2(3H)-benzothiazolylidene]methyl]-4,4a,5,6-tetrahydro-2(3H)-naphthalenylidene]-methyl]-5-(methylthio)benzothiazolium iodide sensitizing dye (0.055 g), MEK (17.017 g) and methanol (51.053 g), and 0.755 g of 2-mercapto-5-methyl-benzimidazole, BUTVAR® B-79 polyvinyl butyral (34.550 g) with stirring after cooling to 13° C., Antifoggant solution (20.084 g) containing 2-tribromomethyl-sulfonylquinoline (12.132 g) in MEK (148.54 g), Solution (1.284 g) containing DESMODUR N3300 isocyanate hardening agent (6.418 g) in MEK (12.837 g), Solution (5.957 g) containing phthalazine (8.333 g) in MEK (39.324 g), Solution (1.164 g) containing tetrachlorophthalic acid (1.862 g) in MEK (3.724 g) and methanol (3.724 g), Solution (4.863 g) containing 4-methylphthalic acid (4.166 g) in methanol (3.277 g), Permanax WSO (10.418 g), and MEK (31.464 g), and Solution (3.411 g) containing potassium salt of ethyl (hydroxy-methylene)cyanoacetate (1.498 g) in methanol (6.447 g) and MEK (19.346 g).

A topcoat formulation was prepared as follows:

A polymer solution containing MEK (491.615 g), methanol (64.85 g), cellulose acetate butyrate resin (CAB 171-15S, Eastman Chemicals Company, 40.778 g) and ACRYLOID A-21 acrylic polymer (Rohm & Haas, 1.57 g). To this solution was added vinyl sulfone (VS-1) (1.619 g, 74% solids) and cyclobutenediylium, 1,3-bis[2,3-dihydro-2,2-bis [[1-oxohexyl)oxy]methyl]-1H-perimidin-6-yl]-2,4-dihydroxy-, bis(inner salt) (0.285 g).

The noted formulations were applied to a polyethylene terephthalate film support (4 mil, 102 $\mu$m) already having an antihalation backcoat applied out of the following 4261 kg formulation at 54 g/m$^2$:

| A Backcoat Formulation was prepared as follows: | |
|---|---|
| MEK | 77.9599 weight % |
| Cellulose acetate butyrate (CAB 500-5) | 8.4682 weight % |
| Cellulose acetate butyrate (CAB 381-20) | 2.8222 weight % |
| Indolenine cyanine dye having structure VII (shown below) | 0.0714 weight % |
| Acetone | 4.6339 weight % |
| α-(2-aminoethyl)-ω-(2-aminoethoxy)-poly(oxy-1,2-ethaneidyl)-1,1,2,2,3,3,4,4,5,5,6,6,7,7,8,8,8-heptadecafluoro-1-octane sulfonate (75%) antistatic agent | 1.0374 weight % |
| MEK | 3.6831 weight % |
| VITEL 2200 polyester (Bostik, Inc., Middleton, MA) | 0.5647 weight % |
| GASIL 23F amorphous silica | 0.0212 weight % |

-continued

A Backcoat Formulation was prepared as follows:

| | |
|---|---|
| Slip-Ayd SL-530 polyethylene resin (18% solids) | 0.1244 weight % |
| n-Butyl nickelate (Tetrabutylammonium bis(cis-1,2-dicyano-1,2-ethenedithiolato)-nickelate(1-) H. W. Sands, Jupiter, FL) | 0.0142 weight % |
| Acetone | 0.5993 weight % |

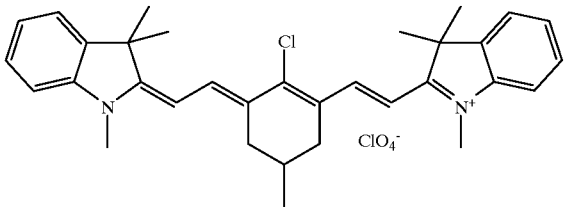

VII

3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

The imaging formulation and the topcoat formulation were applied to the polyester film support simultaneously using a dual knife coating apparatus with a 2.4 mil (61 $\mu$m) gap for the imaging formulation and a 1.2 mil (30 $\mu$m) gap for the topcoat formulation. The material was dried for 4 minutes at 85° C.

Barrier layer formulations were prepared as follows:

| Material | Barrier Layer Component(s) |
|---|---|
| Control B | None |
| Example 7 | Polyvinyl alcohol (50 g at 10% solids in 50:50 methanol/water) and Vitamin B12 (0.109 g) |
| Example 8 | Polyvinyl pyrrolidone (15% in methanol) |
| Example 9 | Polyvinyl pyridine (15% in methanol) |
| Example 10 | Polyvinyl alcohol (50 g at 10% solids) and silver nitrate (0.312 g) in 50:50 methanol/water |
| Example 11 | Polyvinyl alcohol (10% solids) in 50:50 methanol/water |
| Example 12 | Poly(vinyl chloride-co-vinyl acetate) (15% solids) in 50:50 MEK/toluene |
| Example 13 | Polystyrene (15% solids) in MEK |

Each barrier layer formulation was coated over the imaging and topcoat material. The coating gap was 1.5 mil (38 $\mu$m). The resulting photothermographic material was dried for 4 minutes at 85° C.

Films of each material were converted into 10.1×20.2 cm samples for image fog testing. To these samples were adhered using SCOTCH brand masking tape, control strips (10.1×55.9 cm) of a high contrast photothermographic material that had been exposed to 25 Watt incandescent lights through a KODAK 1A filter for 20 seconds. These samples were then heat-developed with the photothermographic emulsion side down in a Kodak Model 2771 processor having silicone rollers. The exposed portion of the samples entered the processor first. The sample was transported through the processor at 0.36 in/sec (0.91 cm/sec, 2/3 speed).

After thermal processing, each 20.2 cm sample was evaluated to see how much developed image (fogging) occurred on the unexposed portion due to undesirable migration of fogging agent that had evolved from the exposed portion of the sample during processing of each sample. The distance into the sample that the development occurred was recorded (in cm) where the optical density had decreased to 1.0.

| Material | Distance to 1.0 Optical Density |
|---|---|
| Control B | 14 cm |
| Example 7 | 0 cm |
| Example 8 | No result, machine jam |
| Example 9 | 0 cm |
| Example 10 | 0 cm |

All of the photothermographic samples exhibited equivalent sensitometric results ($D_{min}$, $D_{max}$, Speed, Contrast B and Contrast D). However, some differences may have existed in sample photospeed. Moreover, the barrier layers used in the present invention appear to improve the shelf life of the photothermographic materials as shown in the following results showing changes in sensitometric properties after 9 months keeping at ambient conditions.

| Material | $\Delta D_{min}$ | ΔSpeed | ΔContrast B | ΔContrast D |
|---|---|---|---|---|
| Control B | +0.024 | −0.39 | −2.8 | −19 |
| Example 7 | +0.026 | −0.09 | −1.0 | −10 |
| Example 8 | +0.014 | −0.14 | −2.2 | −13 |
| Example 9 | +0.025 | −0.02 | −1.8 | −12 |
| Example 10 | −0.038 | −0.15 | −0.7 | −18 |

It is apparent that the $D_{min}$ for the Invention materials were the same or better than that in Control B after 9-month storage while the speed and contrast measurements are improved relative to Control B.

In another set of experiments, additional barrier layer materials were evaluated for image fog and sensitometric properties. The image fog reduction was shown to be an effect of solely the polyvinyl alcohol and unrelated to the presence of Vitamin B 12 or silver nitrate. The image fogging results are shown as follows:

| Material | Distance to 1.0 Optical Density |
|---|---|
| Control C | >19 cm |
| Example 11 | 0 cm |
| Example 12 | 0 cm |
| Example 13 | 0 cm |

All of the photothermographic samples exhibited equivalent sensitometric results ($D_{min}$, $D_{max}$, Speed, Contrast B and Contrast D). However, the barrier layers used in the present invention improved the shelf life of the photothermographic materials as shown in the following results showing changes in sensitometric properties after 9-months keeping at ambient conditions.

| Material | $\Delta D_{min}$ | ΔSpeed | ΔContrast B | ΔContrast D |
|---|---|---|---|---|
| Control C | +0.207 | −0.15 | −5.1 | −28 |
| Example 11 | +0.026 | −0.07 | −3.1 | −19 |
| Example 12 | +0.027 | −0.26 | −4.0 | −24 |
| Example 13 | +0.375 | −0.41 | −6.3 | −29 |

Examples 14–20

Additional barrier layer polymers were evaluated as part of barrier layers in photothermographic materials similar to those used for Examples 7–13.

An imaging formulation was prepared as follows:

A preformed soap homogenate (147.88 g at 28% solids, 1.3689% BUTVAR® B-79 polyvinyl butyral, 26.6311% preformed soap) was added to a glass jar. The dispersion was stirred at a constant rate of 500 rpm using a pitched blade impeller at 21° C. To this dispersion was added the following components in the noted order:

Pyridinium hydrobromide perbromide (1.632 g) in methanol (4.878 g), 0.868 g of solution, Zinc bromide (1.846 g) in methanol (4.940 g), 0.905 g of solution, BUTVAR® B-79 polyvinyl butyral (0.951 g), Sensitizing dye solution (10.471 g) containing 2-(p-chlorobenzoyl)benzoic acid (14.889 g), 3-ethyl-2-[[7-[[3-ethyl-5-(methylthio)-2(3H)-benzothiazolylidene]methyl]-4,4a,5,6-tetrahydro-2(3H)-naphthalenylidene]-methyl]-5-(methylthio) benzothiazolium iodide sensitizing dye (0.051 g), MEK (15.696 g), methanol (47.027 g), and 2-mercapto-5-methylbenzimidazole (0.869 g).

BUTVAR® B-79 polyvinyl butyral (33.961 g) with stirring after cooling to 13° C., Antifoggant solution (19.584 g) containing 2-tribromomethylsulfonylquinoline (10.056 g) in 136.83 g of MEK, Solution (1.254 g) containing DESMODUR N3300 isocyanate hardening agent (3.152 g) in MEK (36.208 g), Solution (5.851 g) containing phthalazine (7.674 g) in MEK (36.208 g), Solution (1.146 g) containing tetrachlorophthalic acid (1.715 g) in MEK (3.439 g) and methanol (3.439 g), Solution (4.772 g) containing 4-methylphthalic acid (3.837 g) in methanol (3.002 g) and MEK (28.954 g), PERMANAX WSO phenol (10.239 g), and Solution (2.149 g) containing potassium salt of ethyl (hydroxymethylene)cyanoacetate (1.380 g) in methanol (14.738 g).

The imaging, formulation was coated onto a polyethylene terephthalate film support (4 mil, 102 μm) previously coated with an antihalation backcoat having the same composition as that described above for Examples 7–13. A knife coating apparatus was used. The coating gap was 2.8 mil (71 μm). The coating was dried for 2 minutes at 85° C.

A topcoat formulation was prepared as follows:

A polymer solution containing MEK (184.37 g), methanol (24.114 g), cellulose acetate butyrate (CAB 171-15S, Eastman Chemicals Company, 33.773 g) and ACRYLOID A-21 acrylic polymer (Rohm & Haas, 1.299 g) was diluted with MEK (255.2 g). To this solution was added vinyl sulfone (1.860 g, 80% solids) and cyclobutenediylium, 1,3-bis[2,3-dihydro-2,2-bis [[1-oxohexyl)oxy]methyl]-1H-perimidin-6-yl]-2,4-dihydroxy-, bis(inner salt) (0.354 g).

Barrier layer formulations were prepared as follows:

All barrier layer formulations were prepared at 7.0% solids in 2-butanone unless otherwise specified.

| Material | Barrier Layer Component(s) |
|---|---|
| Control D | No Barrier Layer |
| Example 14 | Poly(vinylidene chloride) |
| Example 15 | Poly(styrene-co-methacrylate (70:30 weight) |
| Example 16 | TYRIL 880B poly(styrene-co-acrylonitrile) (Dow Chemical) |

-continued

| Material | Barrier Layer Component(s) |
|---|---|
| Example 17 | Polystyrene (mol. wt. 800–5,000) |
| Example 18 | Polystyrene (mol. wt. 50,000) |
| Example 19 | Polystyrene (mol. wt. 125–250,000) |
| Example 20 | PARALOID A-11 acrylic polymer (Rohm & Haas) |

The barrier layer and topcoat formulations were simultaneously coated onto the dried imaging layer using a dual knife coating apparatus. The gap for the barrier layer formulation was 1.0 mil (25 μm). The gap for the topcoat formulation was 1.2 mil (30 μm). Coated samples were dried for 2 minutes at 85° C. Thus, the topcoat was the outermost layer of the photothermographic materials, and the barrier layer was interposed between it and the imaging layer.

Films of each material were converted into three 6.4 cm×30.5 cm samples for image fog testing. Two of the samples of each material were exposed to 25 Watt incandescent lights through Kodak 1A filters for 20 seconds. The third sample of each material was adhered to the first two with masking tape. The samples were then heat-developed with the photothermographic emulsion side down in a Kodak Model 2771 processor having silicone rollers. The exposed portion of the samples entered the processor first. The sample was transported through the processor at 0.36 in/sec (0.91 cm/sec, 2/3 speed).

After heat development, each 30.5 cm sample was evaluated to see how much developed image (fogging) occurred on the unexposed portion due to migration of fogging agent that had evolved from the exposed portion of the sample during processing of the sample. The distance into the sample (in cm) where development occurred such that the optical density had decreased to 1.0 was recorded. A lower distance value is preferred. A distance value of 0 cm indicates no fog. The results are as follows:

| Material | Distance to 1.0 Optical Density |
|---|---|
| Control D | 1.8 cm |
| Example 14 | 0 cm |
| Example 15 | 0 cm |
| Example 16 | 0 cm |
| Example 17 | 0 cm |
| Example 18 | 0 cm |
| Example 19 | 0 cm |
| Example 20 | 0 cm |

All of the photothermographic samples exhibited equivalent sensitometric results ($D_{min}$, $D_{max}$, Speed, Contrast B and Contrast D). However, some differences may exist in photospeed. Moreover, some barrier layers used in the present invention appeared to improve the shelf life of the photothermographic materials as shown in the following results showing changes in sensitometric properties after a 3-month natural aging.

| Material | $\Delta D_{min}$ | ΔSpeed |
|---|---|---|
| Control D | 0 | −0.02 |
| Example 15 | 0 | +0.06 |
| Example 16 | −0.006 | +0.06 |
| Example 17 | −0.01 | +0.05 |

-continued

| Material | $\Delta D_{min}$ | ΔSpeed |
|---|---|---|
| Example 18 | −0.002 | +0.04 |
| Example 19 | 0 | +0.04 |
| Example 20 | −0.005 | +0.03 |

It is apparent that the $D_{min}$ values for the photothermographic materials of the present invention were the same or better than the $D_{min}$ value in Control D after a 3-month storage while the speed measurements are improved relative to Control D.

EXAMPLES 21–39

Additional polymers were evaluated as topcoat barrier layers instead of as interlayers in photothermographic materials prepared in a similar manner to those of Examples 7–13.

Imaging and topcoat formulations were prepared in a manner similar to that described in those examples.

Barrier layer formulations were prepared at 7.0% solids in 2-butanone unless otherwise specified. The polymers evaluated in the barrier layers were as follows:

| Material | Barrier Layer Component(s) |
|---|---|
| Control D | No Barrier Layer |
| Example 21 | Polystyrene (mol. wt. 45,000) |
| Example 22 | Polystyrene (mol. wt. 50,000) |
| Example 23 | Polystyrene (mol. wt. 65,000) |
| Example 24 | Polystyrene (mol. wt. 190,000) |
| Example 25 | Polystyrene (mol. wt. 280,000) |
| Example 26 | STYRON 685D polystyrene (Dow Chemical) |
| Example 27 | STYRON 484 polystyrene (Dow Chemical) |
| Example 28 | Poly(p-t-butyl styrene) |
| Example 29 | Poly(4-methyl styrene) |
| Example 30 | Poly(4-methoxy styrene) |
| Example 31 | Polystyrene sulfonate in water |
| Example 32 | Poly(styrene-co-acrylonitrile) (75:25 weight) |
| Example 33 | U CAR VYNS-3 poly(vinyl chloride-co-vinyl acetate) (Union Carbide) |
| Example 34 | U CAR VAGH poly(vinyl chloride-co-acetate-co-vinyl alcohol) (Union Carbide) |
| Example 35 | U CAR AYAF poly(vinyl acetate) (Union Carbide) |
| Example 36 | S-LEC KS-3 poly(vinyl acetal) (Sekisui Chemical) |
| Example 37 | Prince 5130 polyester resin (Lawter International) in water |
| Example 38 | Poly(ethylene-co-vinylacetate) (55:45 weight) |
| Example 39 | Gelatin (K & K Type 1312) in water |

Films of each material were converted into 10 cm×30.5 cm sheet samples for image fog testing that was carried out in the same manner as described as Examples 14–20. The results are shown as the fogging distance in cm when the image fog testing was carried out at 50% RH and 24° C. unless otherwise specified.

| Material | Distance to 1.0 Optical Density |
|---|---|
| Control D | 2.4 cm (30% RH, 21° C.) |
| Control D | 5.4 cm (40% RH, 21° C.) |
| Control D | 8.6 cm (50% RH, 24° C.) |

-continued

| Material | Distance to 1.0 Optical Density |
|---|---|
| Control D | 19.1 cm (80% RH, 27° C.) |
| Example 21 | 6.3 |
| Example 22 | 2.7 |
| Example 23 | 1.1 |
| Example 24 | 2.3 |
| Example 25 | 1.9 |
| Example 26 | 0.6 |
| Example 27 | 0 |
| Example 28 | 0 |
| Example 29 | 0.3 |
| Example 30 | 3.2 |
| Example 31 | 0 |
| Example 32 | 0 |
| Example 33 | 0 |
| Example 34 | 0 |
| Example 35 | 4.3 |
| Example 36 | 1.2 |
| Example 37 | 0 |
| Example 38 | 3.8 |
| Example 39 | 0 |

EXAMPLE 40

Photothermographic materials were prepared similar to those described in Examples 1–6 above except that 0.08 g of 1-formyl-2-phenylhydrazine was included in the photothermographic formulations as the high contrast agent instead of the cyanoacetates described for those examples.

Over the photothermographic formulation was applied a topcoat also as described in Examples 1–6 above using either cellulose acetate butyrate (Control E, CAB 171-1SS, Eastman Chemicals Company) or polyvinyl alcohol.

After imaging and heat development, both photothermographic materials were evaluated for image development (fogging) in unexposed portions of the materials using the procedure described in Examples 7–13. The distance (cm) into the material that development occurred was recorded where the optical density had decreased to 1.0.

| Material | Distance to 1.0 Optical Density |
|---|---|
| Control E | 13 cm |
| Example 40 | 0 cm |

EXAMPLE 41

An additional film-forming polymer was evaluated as part of a barrier layer in a photothermographic material prepared similar to those described in Examples 14–20 noted above. The imaging formulation comprised a potassium salt of ethyl(hydroxymethylene)cyanoacetate as the high contrast agent. The barrier layer was interposed between the imaging layer and the topcoat. Poly(glycidyl methacrylate) (22% solids) was used as the barrier layer binder.

Samples (10 cm×30.5 cm) of the photothermographic material was subjected to "image fog testing" at 50% R. H. and 24° C. as described in Examples 14–20. The results are shown below as the fogging distance in "cm."

| Material | Distance to 1.0 Optical Density |
|---|---|
| Example 41 | 0 cm |

EXAMPLE 42

A photothermographic material like that described in Example 26 was prepared similarly to the material of that example except that the barrier layer, imaging layer, and topcoat layer formulations were applied to the support simultaneously using conventional coating equipment and technique as described for example in U.S. Pat. No. 5,861,195 (Bhave et al.).

The invention has been described in detail with particular reference to certain preferred embodiments thereof, but it will be understood that variations and modifications can be effected within the spirit and scope of the invention.

We claim:

1. A high contrast black-and-white photothermographic material comprising a support having thereon:

a) a thermally-developable, high contrast imaging layer(s) comprising a binder and in reactive association, photosensitive silver halide, a non-photosensitive source of reducible silver ions, a reducing composition for said non-photosensitive source reducible silver ions, and a high contrast agent, and b) a barrier layer that is on the same side but farther from said support than said high contrast imaging layer(s), said barrier layer comprising a film-forming polymer and being impermeable to or reactive with any components that are diffusible from said image-forming layer(s) at a temperature greater than 80° C.

2. The photothermographic material of claim 1 that further comprises a surface protective layer, and said barrier layer is disposed between said surface protective layer and said high contrast imaging layer(s).

3. The photothermographic material of claim 1 that further comprises a protective layer that is disposed between said barrier layer and said high contrast imaging layer(s).

4. The photothermographic material of claim 1 wherein said non-photosensitive source of reducible silver ions is a silver fatty acid carboxylate having 10 to 30 carbon atoms in the fatty acid or a mixture of said silver carboxylates.

5. The photothermographic material of claim 1 wherein said reducing composition comprises a t least one hindered phenol and said high contrast agent is an acrylonitrile co-developer, an isoxazole co-developer or a hydrazide co-developer.

6. The photothermographic material of claim 5 wherein said high contrast agent is an acrylonitrile co-developer having the formula I:

$$H(R')C{=}C(R)CN \qquad \text{I}$$

wherein R is an aryl group or an electron withdrawing group, and R' is a halo atom, hydroxy or metal salt thereof, a thiohydrocarbyl group, an oxyhydroxycarbyl group, or a 5- or 6-membered aromatic heterocyclic group having only carbon and 1 to 4 nitrogen atoms, and being attached through a non-quatemary ring nitrogen atom.

7. The photothermographic material of claim 5 wherein said high contrast agent is a hydrazide co-developer having the formula II:

$$R_1(CO){-}NHNH_2 \qquad \text{II}$$

wherein $R_1$ is an aliphatic group having up to 20 atoms or a carbocyclic or heterocyclic group having up to 14 atoms in the ring structure.

8. The photothermographic material of claim 5 wherein said high contrast agent is a hydrazide co-developer having the formula III:

$$R_2{-}(C{=}O){-}NHNH{-}R_3 \qquad \text{III}$$

wherein $R_2$ is hydrogen and $R_3$ is an aryl group, or $R_2$ is hydrogen, an alkyl group, an alkenyl group, an alkoxy group, a thioalkoxy group, an amido group, an aryl group, an aryloxy group, a thioaryloxy group, an anilino group, a heterocyclyl group, or a carbocyclyl group, and $R_3$ is a trityl group.

9. The photothermographic material of claim 7 wherein said high contrast agent is a hydrazide co-developer having the formula IV:

$$R_4{-}CO{-}NHNH{-}SO_2R_5 \qquad \text{IV}$$

wherein $R_4$ and $R_5$ are independently an alkyl group, an alkenyl group, an alkoxy group, an aryl group, an aryloxy group, a heterocyclyl group, or a carbocyclyl group.

10. The photothermographic material of claim 1 wherein said imaging layer(s) binder is a hydrophobic binder.

11. The photothermographic material of claim 1 that is sensitive to radiation of from about 300 and to about 850 nm.

12. The photothermographic material of claim 1 wherein said barrier layer comprises at least one film-forming polymer that is impermeable to or reactive with formic acid, hydrazo compounds, diimide compounds, azo compounds, hydrazine, or water.

13. The photothermographic material of claim 1 wherein said barrier layer comprises at least one film-forming polymer that is impermeable to or reactive with fogging agents.

14. The photothermographic material of claim 1 wherein said barrier layer comprises at least one film-forming polymer selected from the group consisting of:

polyvinyl alcohol, a polymer derived from styrene or derivative thereof, a vinyl halide polymer, a vinyl acetate polymer, a water-soluble or water-dispersible polyester, a polyvinyl pyrrolidone, and gelatin or a gelatin derivative.

15. The photothermographic material of claim 14 wherein said barrier layer comprises polyvinyl alcohol, a styrene polymer or a vinyl acetate polymer.

16. The photothermographic material of claim 1 wherein said barrier layer comprises polyvinyl alcohol and silica.

17. The photothermographic material of claim 1 further comprising an antihalation layer.

18. The photothermographic material of claim 1 further comprising a dihydroperimidine squaraine dye.

19. A high contrast black-and-white thermographic material comprising a support having thereon:

a) a thermally-developable and non-photosensitive, high contrast imaging layer(s) comprising a binder and in reactive association, a non-photosensitive source of reducible silver ions, a reducing composition for said non-photosensitive source of reducible silver ions, and a high contrast agent, and b) a barrier layer that is farther from said support than said imaging layer(s), said barrier layer comprising a film-forming polymer and being impermeable to or reactive with any components that are diffusible from said image-forming layer(s) at a temperature greater than 80° C.

20. A high contrast black-and-white photothermographic material comprising a support having on one side thereof:

a) a thermally-developable, high contrast imaging layer(s) comprising a binder and in reactive association, a photosensitive silver halide, one or more non-photosensitive silver carboxylates, a hindered phenol reducing agent, an alkyl(hydroxy-methylene) cyanoacetate high contrast agent, and a polyhalo antifoggant, b) a barrier layer that is farther from said support than said high contrast imaging layer(s), said barrier layer comprising a film-forming polymer that is selected from the group consisting of polyvinyl alcohol (with or without silica), a styrene polymer, a vinyl halide polymer, a vinyl acetate polymer, a polyvinyl pyrrolidone polymer, a water-soluble or water-dispersible polyester, or gelatin or a gelatin derivative, said barrier layer being impermeable to or reactive with formic acid, azo compounds, hydrazo compounds, diimide compounds, hydrazine, or water, and optionally c) a protective layer that can be a topcoat over said barrier layer, or a layer disposed between said barrier layer and said high contrast imaging layer(s), said photothermographic material also comprising an antihalation layer on said support, said antihalation layer comprising a binder and an antihalation dye.

21. The photothermographic material of claim 20 wherein said antihalation layer comprises cyclobutenediylium, 1,3-bis[2,3-dihydro-2,2-bis[[1-oxohexyl)oxy]methyl]-1H-perimidin-6-yl]-2,4-dihydroxy-, bis(inner salt) as an antihalation dye.

22. The photothermographic material of claim 20 wherein said antihalation layer comprises 3H-Indolium, 2-[2-[2-chloro-3-[(1,3-dihydro-1,3 ,3-trimethyl-2H-indol-2-ylidene) ethylidene]-5-methyl-1-cyclohexen-1-yl]ethenyl]-1,3,3-trimethyl-, perchlorate as an antihalation dye.

23. A method of forming a visible image comprising:

A) imagewise exposing the high contrast black-and-white photothermographic material of claim 1 to electromagnetic radiation to form a latent image, B) simultaneously or sequentially, heating said exposed photothermographic material to develop said latent image into a visible image.

24. The method of claim 23 wherein said photothermographic support is transparent and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

25. The method of claim 20 wherein said imaging radiation is ultraviolet, visible or infrared radiation.

26. The method of claim 20 wherein said photothermographic material is exposed using a laser in a multilogitudinal manner.

* * * * *